US005145730A

United States Patent [19]

Cheng

[11] Patent Number: 5,145,730

[45] Date of Patent: Sep. 8, 1992

[54] STEMMED FLOWER-LIKE DECORATION AND METHOD OF MAKING SAME

[76] Inventor: Peter S. C. Cheng, 5 Ross Street, Toronto, Ontario, Canada, M5T 1Z8

[21] Appl. No.: 787,603

[22] Filed: Nov. 4, 1991

[51] Int. Cl.[5] ..... A41G 1/00

[52] U.S. Cl. ..... 428/24; 156/61

[58] Field of Search ..... 428/24, 25, 26; 156/61

[56] References Cited

U.S. PATENT DOCUMENTS 1,470,969 10/1923 Greene ..... 156/61
1,731,089 10/1929 Adams ..... 156/61 X
3,822,171 7/1974 Bouillot ..... 428/24 X
4,333,778 6/1982 Griffin ..... 428/24 X
4,525,394 6/1985 Standley ..... 156/61 X

*Primary Examiner*—Henry F. Epstein
*Attorney, Agent, or Firm*—Kirschstein, Ottinger, Israel & Schiffmiller

[57] ABSTRACT

A stemmed, flower-like decoration is formed by folding strip regions of an elongated strip of flexible material about fold lines intersecting each other, and by overlapping the strip regions to impart a dish-shape to the folded strip. One or more dish-shaped strips are attached to a stem.

9 Claims, 1 Drawing Sheet

FIG. 1
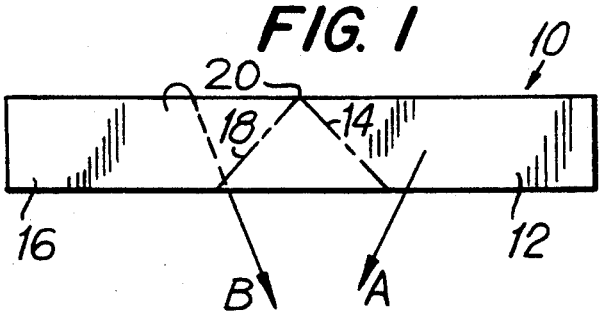
FIG. 2
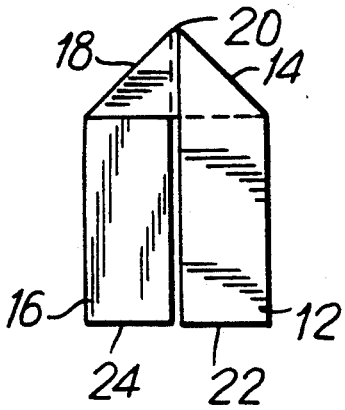
FIG. 3
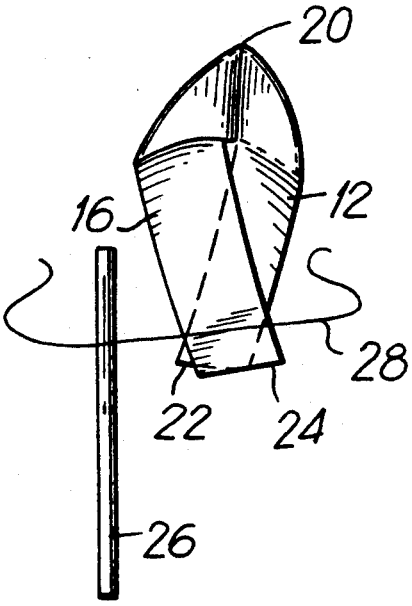
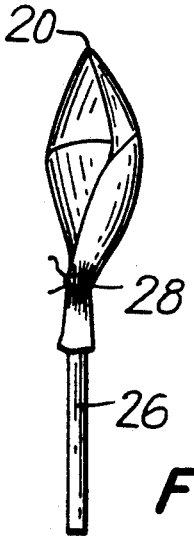
FIG. 4
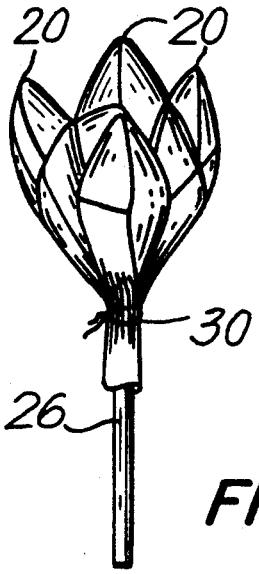
FIG. 5

STEMMED FLOWER-LIKE DECORATION AND METHOD OF MAKING SAME

BACKGROUND OF THE INVENTION

1. Field of the Invention

This invention relates to the art of folding flexible materials such as paper, plastic, cloth and the like to make flower-like decorations.

2. Description of Related Art

It is well known to make flower-like decorations by folding flexible materials. Many such folding techniques require training and a practiced manual dexterity. The need exists for a folding technique requiring minimal training and dexterity, and yet, which produces an attractive decoration in an inexpensive, rapid manner.

SUMMARY OF THE INVENTION

1. Objects of the Invention

It is an object of this invention to produce an attractive, stemmed, flower-like decoration.

It is another object of this invention to form such a decoration in an inexpensive, rapid manner.

It is yet another object of this invention to minimize the training and dexterity required to form such a decoration.

2. Features of the Invention

In keeping with these objects and others which will become apparent hereinafter, one feature of this invention resides, briefly stated, in a stemmed, flower-like decoration and method of making same, which comprises folding an elongated planar strip of flexible material, preferably a ribbon material constituted of paper, plastic, cloth and the like, about fold lines that intersect each other to form strip regions spaced apart of each other. Preferably, the strip regions are located at opposite ends of the strip and extend generally parallel to each other after folding.

Thereafter, the strip regions are partly overlapped at their outer free ends to impart a dish shape to the folded strip. The dish-shaped strip or petal is then attached to an elongated stem to form a bud-like decoration.

Additional strips, identical to the first-mentioned strip, may be folded, overlapped and attached to the stem to form a multi-petaled, flower-like decoration. A single string may be used to encircle all the strips, or multiple strings can be used, to attach the strips to the stem. Other attachment techniques include glueing, melting wax or heat- and pressure-welding.

The number of additional strips to be attached is selected to reach the desired size and fullness of the flower-like decoration. Rather than using individual, discrete strips, this invention also contemplates folding a single elongated strip to form all the individual petals of the flower-like decoration.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a top plan view of a planar strip prior to being folded to form a decoration;

FIG. 2 is a top plan view of the strip of FIG. 1 after being folded;

FIG. 3 is a perspective view of the folded strip of FIG. 2 having its ends partly overlapped and ready to be attached to a stem;

FIG. 4 is a perspective view of the folded strip of FIG. 3 after being attached to the stem; and FIG. 5 is a perspective view analogous to FIG. 4, but showing multiple folded strips.

DETAILED DESCRIPTION OF THE PREFERRED EMBODIMENTS

Referring to FIG. 1, reference numeral 10 generally identifies an elongated planar strip of flexible material extending along a longitudinal axis and constituted of paper, plastic, cloth or the like. In the preferred embodiment, the strip 10 is a fibrous ribbon.

One ribbon end or strip region 12 is folded about linear fold line 14 in one circumferential direction about the axis in the direction of arrow A. The opposite ribbon end or strip region 16 is folded about linear fold line 18 in the opposite circumferential direction about the axis in the direction of arrow B. The fold lines 14, 18 include a right angle therebetween, although other angles are contemplated. The strip regions 12, 16, after being folded, extend in mutual parallelism in a direction normal to the longitudinal axis of the strip (see FIG. 2). The strip regions 12, 16 extend from a common tip 20 to outer free ends 22, 24, respectively.

As shown in FIG. 3, the outer free ends 22, 24 are overlapped by bringing the strip regions 12, 16 together. This overlapping action changes the shape of the folded strip from a planar to a shallow, concave, dish-shaped configuration. The dish-shaped strip is attached to an upper region of an elongated stem 26 by an attachment means, e.g. a string 28 that is tied about the overlapped strip regions to encircle the stem.

FIG. 4 depicts a single dish-shaped strip or petal attached to stem 26 by string 28 to form a budlike decoration. Other suitable attachments include glueing the petal in place on the stem, applying molten wax between the petals and the stem and allowing the wax to set, welding the petal to the stem by application of heat and/or pressure, etc.

FIG. 5 depicts multiple dish-shaped strips or petals circumferentially arranged about the stem and attached thereto by a single string 30, or by any of the other attachments described above. The number of petals is dictated by the desired size and fullness of the flower-like decoration to be formed.

It will be understood that each of the elements described above, or two or more together, also may find a useful application in other types of constructions differing from the types described above.

While the invention has been illustrated and described as embodied in a stemmed flower-like decoration and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A method of forming a stemmed, artificial flower decoration, comprising the steps of:

(a) folding an elongated, planar strip of flexible material extending along a longitudinal axis about fold lines that intersect each other to form strip regions spaced apart of each other and extending in mutual parallelism generally perpendicularly of the longitudinal axis;

(b) thereafter partly overlapping the strip regions by bringing the strip regions together to shape the folded strip as a self-standing, concave petal; and (c) attaching the concave petal to an elongated stem.

2. The method according to claim 1, wherein the folding, overlapping and attaching steps are performed for a plurality of individual strips of flexible material.

3. The method according to claim 2, wherein the attaching step is performed by tying a single string about the overlapped strip regions of all the strips.

4. The method according to claim 1, wherein the folding step is performed by folding the strip regions in opposite circumferential directions about the longitudinal axis.

5. The method according to claim 1, wherein the folding step includes forming the fold lines at a right angle to each other.

6. A stemmed, artificial flower decoration, comprising:

(a) a self-standing, concave petal of flexible material, said petal having an upper pointed end and a plurality of integral strip regions foldable about fold lines that intersect each other and extending away from the upper pointed end, said strip regions being movable from a mutually parallel state to a partly overlapping state by which the petal is shaped with a self-standing, concave configuration;

(b) a stem; and (c) means for attaching the petal to the stem.

7. The decoration according to claim 6; and further comprising a plurality of said petals, and wherein the attaching means attaches all the petals to the stem.

8. The decoration according to claim 7, wherein the attaching means is a single string tightly encircling all the petals and tied to the stem.

9. The decoration according to claim 6, wherein the fold lines include a right angle with each other.

* * * * *